United States Patent [19]

McManus

[11] Patent Number: 4,619,090

[45] Date of Patent: Oct. 28, 1986

[54] TRUSS ASSEMBLY FOR BRICK WALL OR MASONRY SUPPORT

[76] Inventor: Ira J. McManus, 39 Lincoln Ave., Florham Park, N.J. 07932

[21] Appl. No.: 631,179

[22] Filed: Jul. 16, 1984

[51] Int. Cl.[4] ..... E04B 1/30

[52] U.S. Cl. ..... 52/235; 52/283; 52/378; 52/693

[58] Field of Search ..... 52/690, 693, 235, 283, 52/73, 378, 410

[56] References Cited

U.S. PATENT DOCUMENTS

| | | | |
|---|---|---|---|
| 2,078,069 | 4/1937 | Eliel | 52/283 |
| 4,423,576 | 1/1984 | Farina et al. | 52/235 |
| 4,432,289 | 2/1984 | Norman et al. | 52/410 |

FOREIGN PATENT DOCUMENTS

| | | | |
|---|---|---|---|
| 2006641 | 8/1971 | Fed. Rep. of Germany | 52/235 |
| 2540915 | 6/1976 | Fed. Rep. of Germany | 52/235 |
| 1555267 | 2/1968 | France | 52/235 |

*Primary Examiner*—William F. Pate, III
*Assistant Examiner*—Caroline Dennison
*Attorney, Agent, or Firm*—W. Patrick Quast

[57] ABSTRACT

A truss assembly for supporting a building brick or masonry wall comprising a top and bottom chord, a plurality of vertical and diagonal stud members interconnected between the chords; and a lintel angle, for supporting the brick wall, connected to the bottom of the stud members at least. Tieback members are provided which secure the wall to the truss assembly. Adjustment provisions allow aligning the truss assembly both vertically and horizontally before the wall is constructed. A further stud member spans the truss assembly horizontally and provides a physical connection between the truss and the concrete floor systems. Bracing is provided between the column supports, by interconnecting members between the floor slab and the bottom portion of the truss assembly.

10 Claims, 12 Drawing Figures

TRUSS ASSEMBLY FOR BRICK WALL OR MASONRY SUPPORT

BACKGROUND OF THE INVENTION

The present invention relates to a truss assembly and more particularly to a truss assembly which is constructed in a way so as to support a brick wall or other heavy mortar construction.

The most prevalent prior art is a continuous horizontal shelf angle, upon which brickwork is placed, and which is hung from the main building floor and roof steel. Vertical studs are fitted behind the hung angles and connected individually to the building steel and hung angle and braced to the building frame.

One problem with the prior art, steel support assembly is the cost of erecting the steel support and then attaching a brick or masonry wall to the steel support.

An object of the present invention is to minimize the cost of material and labor for constructing a brick wall and steel support assembly.

Another object of the present invention is to avoid complicated attachment parts for attaching the brick wall to the truss.

Another object of the present invention is to permit shop assembly of the truss, and to permit field assembly on the ground of the sheetrock and most attachment parts for the brick wall before lifting the truss into place.

Another object of the invention is to prevent cracking of the brick by removing support of the brick veneer from the floor and roof support beams, which deflect and move under service loads, and apply the support of the brick directly to the columns which are unyielding.

Another object of the present invention is the shop fabrication of the truss in one piece for quicker mounting, leveling, and attachment to the building.

Another object of the present invention is to improve the method of bracing the truss to the building concrete slab.

Another object is to eliminate the need for a separate concrete metal stop at the slab end and incorporate the concrete stop as part of the truss.

SUMMARY OF THE INVENTION

According to the present invention, a truss assembly for supporting a building, brick or masonry wall comprises a top and bottom chord; a plurality of vertical and diagonal stud members interconnected between the chords; and, a lintel angle, for supporting the brick wall, connected to the bottom of the stud members. Tieback members are secured to the truss assembly and hold the brick wall to the truss assembly. Vertical and horizontal adjustment of the truss can be accomplished insuring a level wall assembly. A further stud member spans the truss assembly horizontally. This provides the edge support for the interior concrete floor and facilitates the fabrication of the floor. Bracing is provided, between the column supports, by interconnecting members between the floor slab and the bottom portion of the truss assembly.

It should be understood that the facing material instead of brick can be stone, granite, slate, etc. tied back to the truss in similar manner.

The above advantages and the subsequent description will be more readily understood by reference to the following drawings.

DETAILED DESCRIPTION OF THE INVENTION

Figure 1:
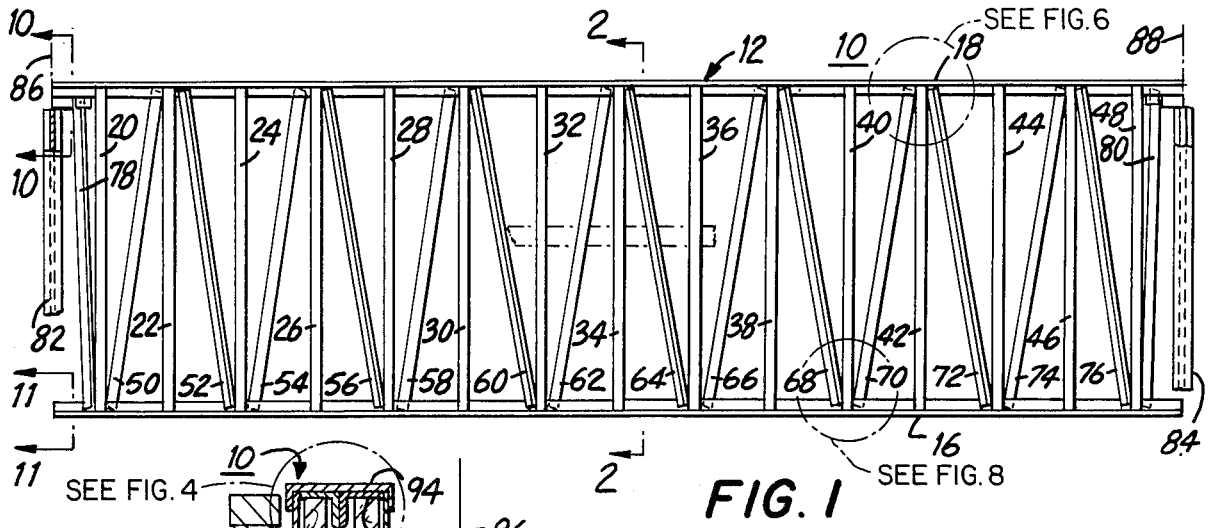
FIG. 1 is an elevation view of a truss assembly according to the present invention.

In FIG. 1, a truss structure assembly 10 is shown. Assembly 10 includes a truss structure or frame 12.

Truss 12 includes a bottom chord 16, a top chord 18, a plurality of vertical studs, 20, 22, 24, 26, 28, 30, 32, 34, 36, 38, 40, 42, 44, 46, 48, a plurality of intermediate diagonals, 50, 52, 54, 56, 58, 60, 62, 64, 66, 68, 70, 72, 74, 76 and a pair of end diagonals 78, 80. Truss 12 is preferably welded in the shop and delivered to the field for subsequent attachment of sheetrock, facing, etc.

Truss 12 is supported on end columns 82, 84, which have respective centerlines 86, 88.

Figure 9:
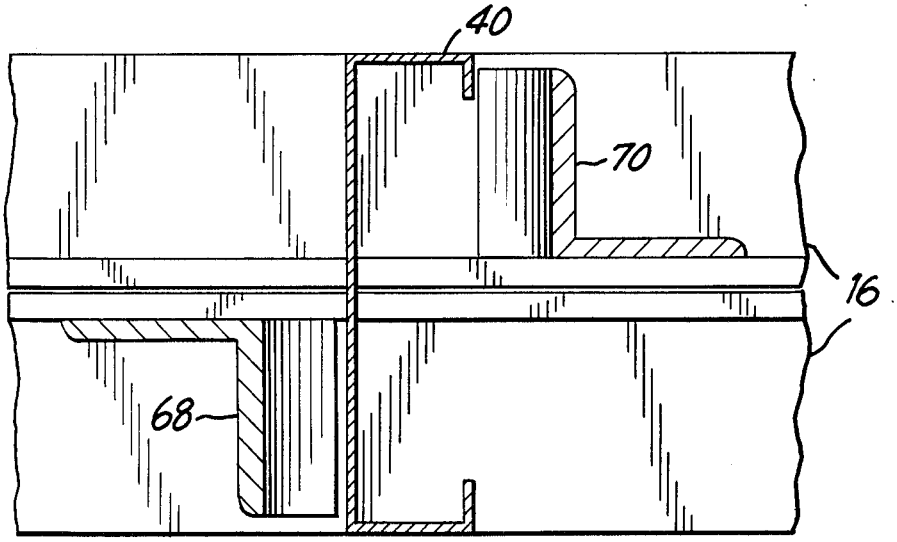
FIG. 9 is a view as taken along the line 9—9 of FIG. 8.

Bottom chord 16, and top chord 18, are each a pair of structural angles welded back to back; or a "tee" section. The vertical studs 20 through 48, which are identical, are each a channel shaped sheet metal member as can be best appreciated from FIGS. 7 or 9. Diagonals 50 through 76, which are identical, are each a formed angle, such as a two and one half inch by two and one half inch structural angle.

Figure 2:
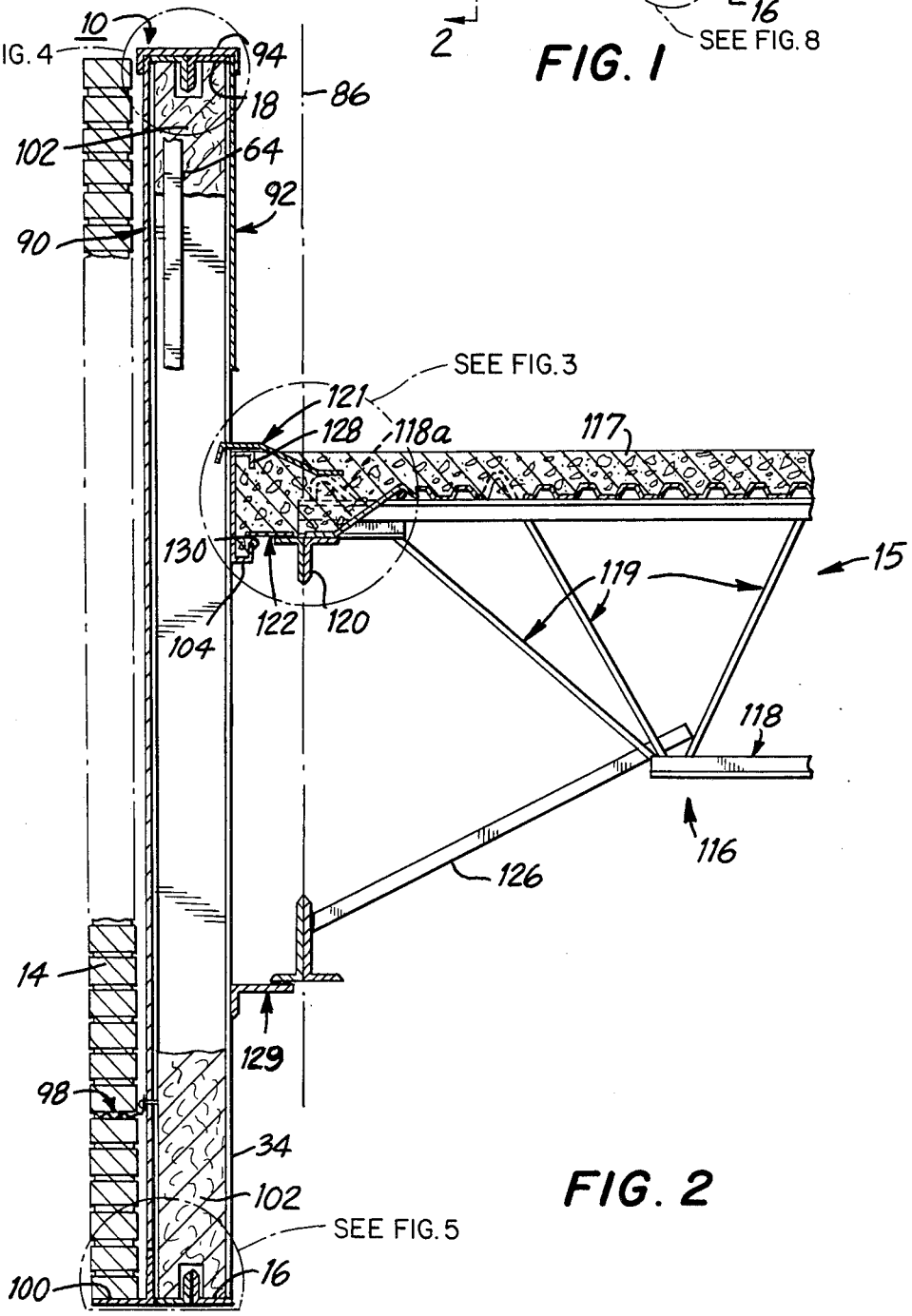
FIG. 2 is a section view as taken along the line 2—2 of FIG. 1.

Assembly 10 includes an exterior sheetrock 90, which is preferably field applied to the truss 12. Assembly 10 also includes an interior sheetrock 92, which is also field applied to truss 12, as shown in FIG. 2. Assembly 10 also has a sheet metal cap 94, which is field applied over top chord 18 if needed.

Figure 4:
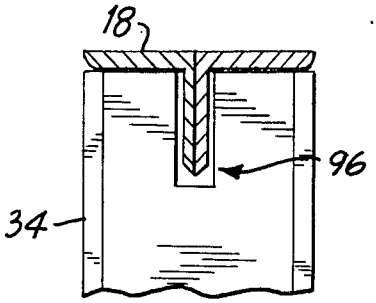
FIG. 4 is an enlarged view of another portion of FIG. 2 without the sheetrock and cap depicted.

In FIGS. 2 and 4, top chord 18 is shown, and is preferably two, three inch by three inch structural angles that are disposed back to back, giving a "tee" appearance in section.

Figure 5:
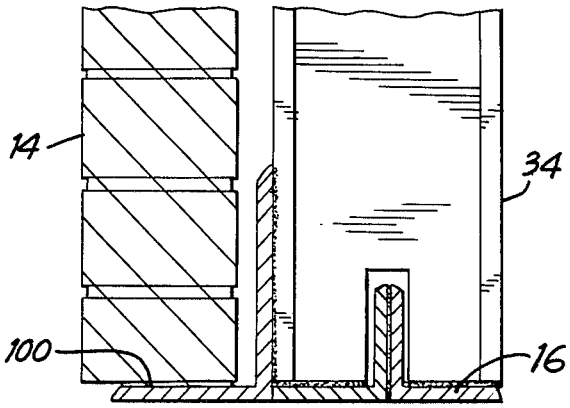
FIG. 5 is an enlarged view of yet another portion of FIG. 2.

In FIGS. 2 and 5, bottom chord 16 is shown and has preferably the same size angles as top chord 18 and is connected similarly.

Figure 6:
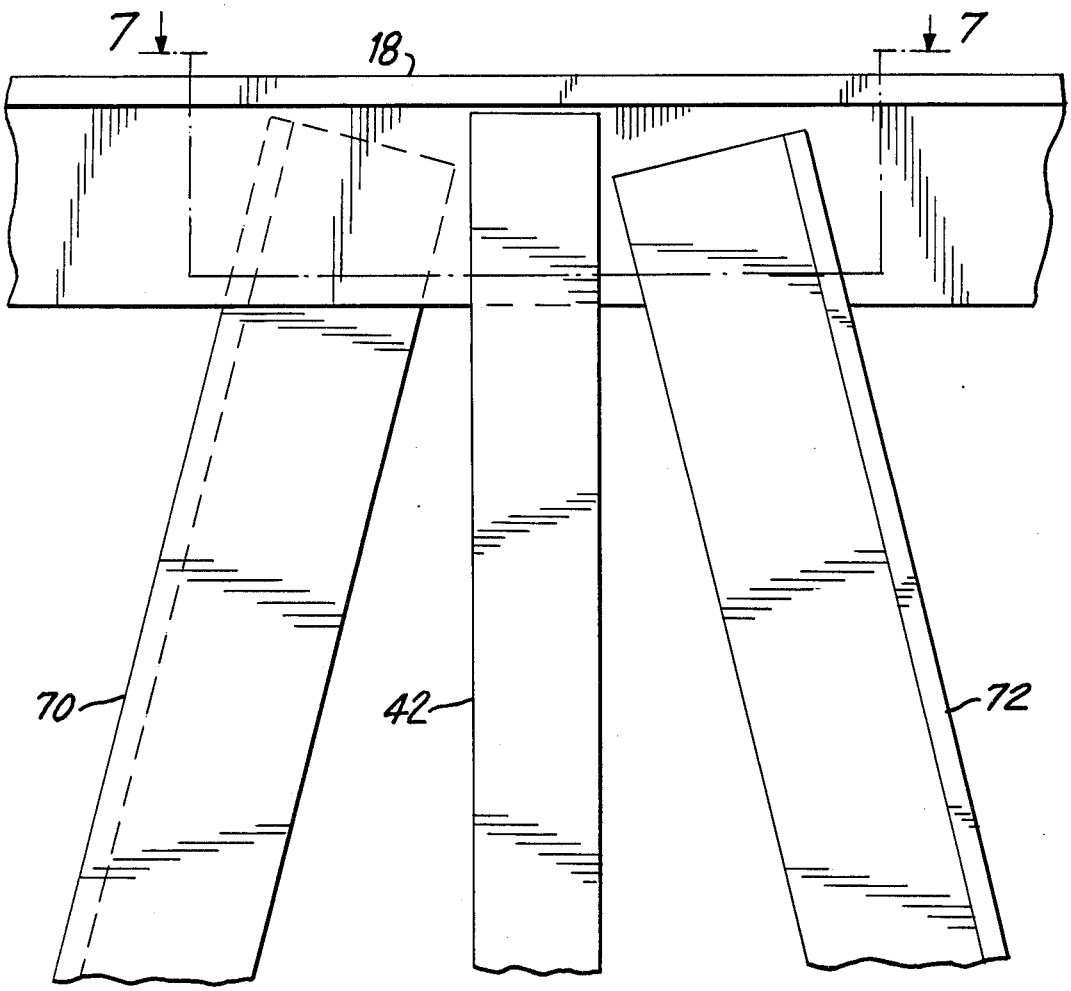
FIG. 6 is an enlarged view of a portion of FIG. 1.
Figure 7:
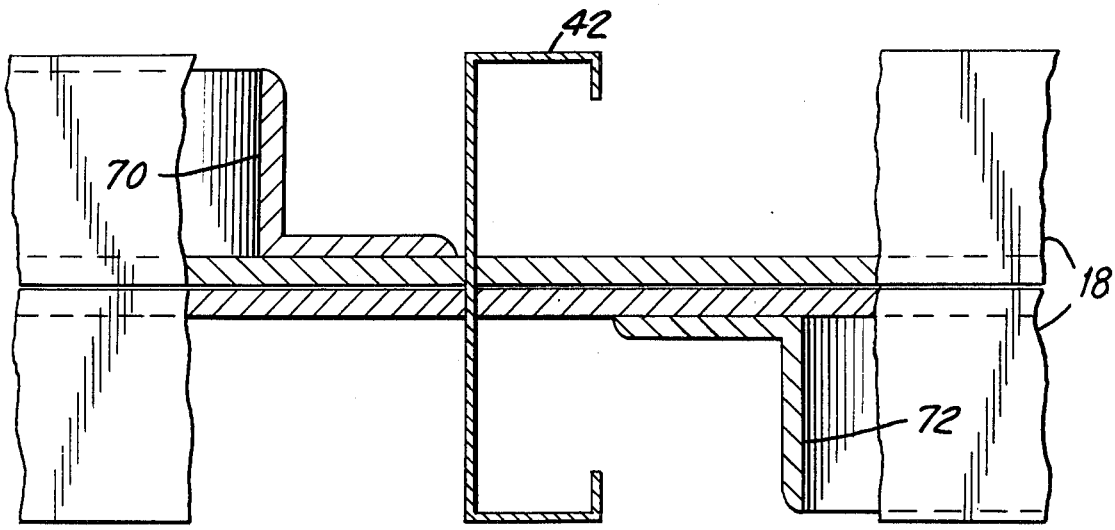
FIG. 7 is a section view as taken along the line 7—7 of FIG. 6.
Figure 8:
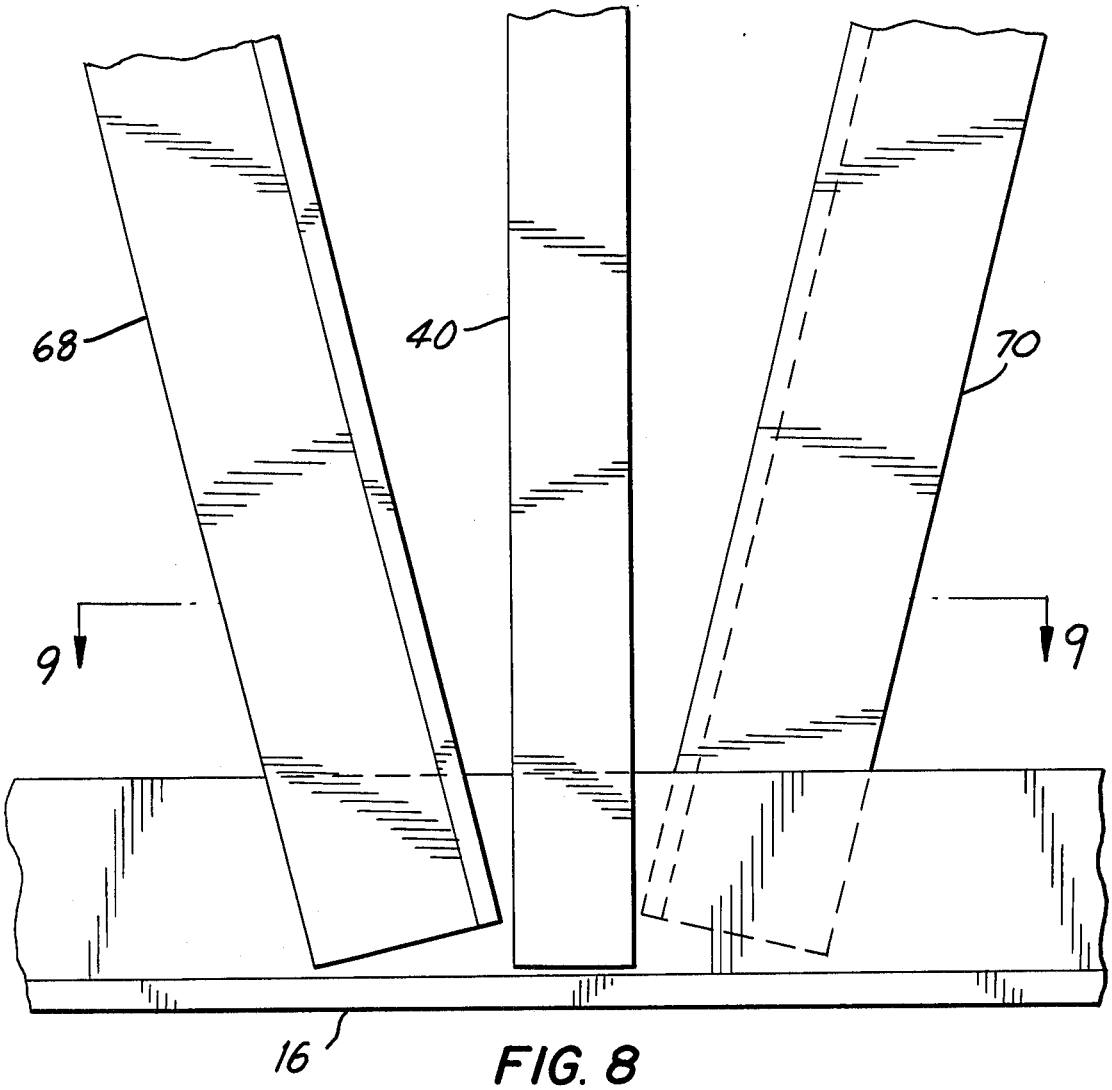
FIG. 8 is an enlarged view of another portion of FIG. 1.

As shown typically in FIG. 4, stud 34 has a notch 96 in order to fit the angle legs of top chord 18. As can be seen in FIG. 5, the bottom of the various studs is likewise notched to fit the angle legs of the bottom chord. The studs are welded at top and bottom to the respective chords. As shown in FIGS. 6 and 7, diagonals 70 and 72, which are typical diagonals, are welded to top chord 18. As shown in FIG. 8, diagonals 68 and 70, again typical, are welded to bottom chord 16. Generally, the diagonals alternate on opposite sides of the chord centers (see FIG. 7).

Figure 12:
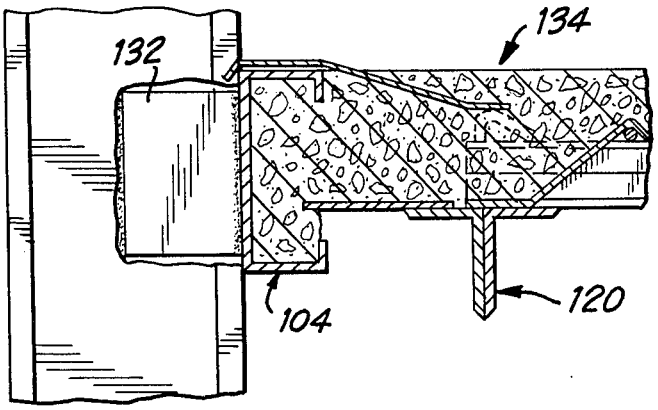
FIG. 12 is an enlarged view of an alternate scheme to that depicted in FIG. 3.

For purposes of this description, wall 14 is a brick veneer. The wall has vertical rows of brick ties 98, which are field applied through the exterior sheetrock 90 to each of the studs 20 through 48, as shown in FIGS. 2 and 12.

Truss 12 has a lintel or shelf angle 100 for supporting the brick wall 14. Lintel 100, as shown in FIGS. 2 and 5, is welded to studs 20 through 48, and welded to bottom chord 16. The brick wall 14 is field applied and bears on lintel angle or plate, 100. It is retained in the vertical plane by the connection of the free end of brick ties 98 to the mortar between the bricks.

Sheetrock 90 and 92, generally, will have insulation batts 102 disposed therebetween. The batts are easily installed in the field between studs and the alternate location of the diagonals allows for installation of the standard size batts without a break in the insulation.

Truss 12 also has a horizontal stud 104 which is welded to studs 20 through 48. Generally, this is channel shaped as shown.

Figure 10:
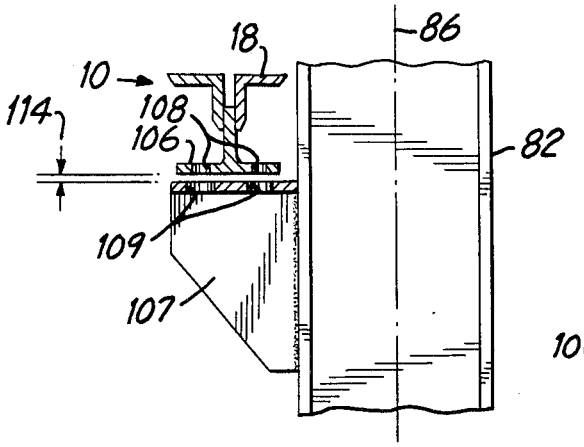
FIG. 10 is a section view as taken along the line 10—10 of FIG. 1.
Figure 11:
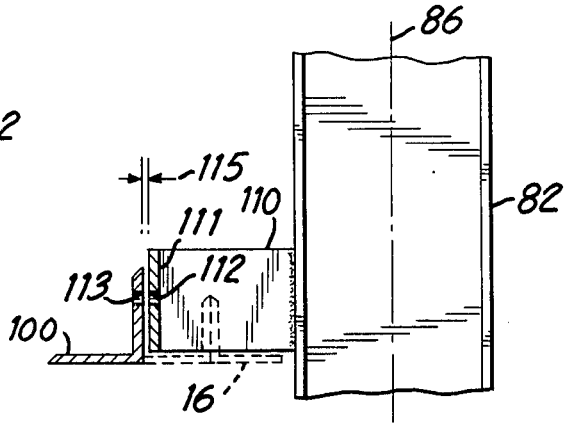
FIG. 11 is a section view as taken long the line 11—11 of FIG. 1.

As shown in FIGS. 10 and 11, truss 10 has top end members, e.g. 106, which are connected to the chord member 18 at its ends. A seating bracket 107 is welded to column 82 and is positioned to provide a seat for member 106.

Member 106 sits on bracket 107 and includes a pair of bolt openings 108 which align with slotted holes 109 in bracket 107.

A support angle bracket 110 is also welded at the bottom of the supporting columns, e.g. 82. The support brackets include a vertical face 111 having a bolt hole 112 which is used to secure the truss assembly lintel 100, thereto. The latter also includes a bolt hole 113 which, in set up, aligns with opening 112.

Shims can be used in the spaces 114 and 115. These, together with the slotted holes allow for both vertical and horizontal adjustment of the truss assembly during field assembly.

As shown in FIG. 2 and in greater detail in FIG. 5, lintel 100 is welded to bottom chord 16. Stud 34 is welded to bottom chord 16. The depth of stud 34 is approximately six inches and the distance from the outside face of brick wall 14 to the outside face of stud 34 approximately five inches. Lintel 100 is also welded to the flange of stud 34 for the height of the lintel.

Referring once again to FIG. 2, building 15 includes a composite floor system 116 such as described in applicant's U.S. Pat. Nos. 4,259,822 or 4,295,310. Such systems include typically a concrete slab layer 117 and an underhanging chord assembly 118. The latter is connected to the slab layer via joist webbing 119. The system rests on a truss or beam supporting joist (e.g., an H beam) 120, which spans columns 82 and 84 near or on the centerline, 86, 88, thereof.

Interconnecting the floor system 116 to the truss assembly 10 is a top connecting plate 121. This typically is welded to and spans from a webbing member, 118*a*, over and behind horizontal stud 104. Typically it is a piece of strap sheet metal (i.e., 2" wide) located at every floor joist or every other joist.

Figure 3:
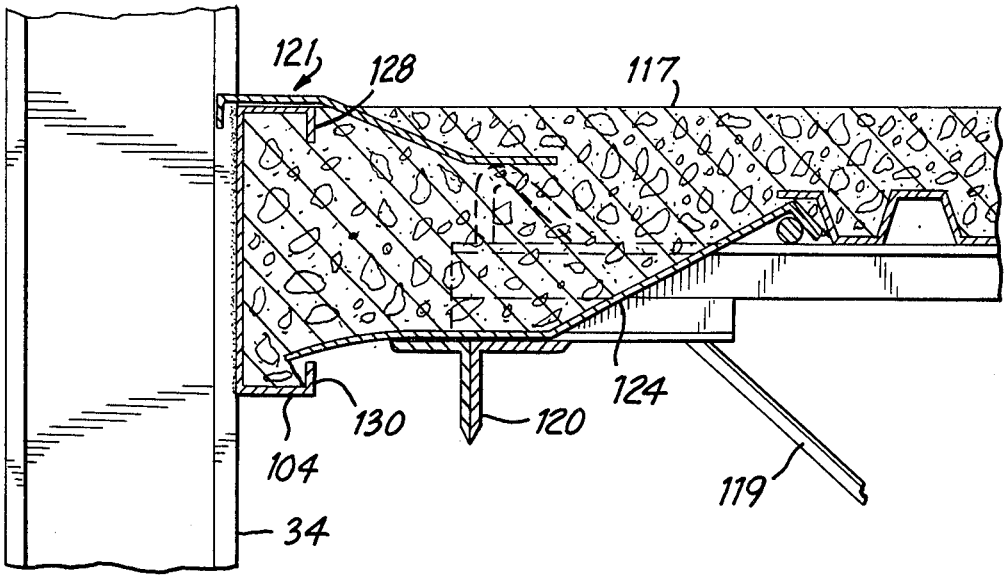
FIG. 3 is an enlarged view of a portion of FIG. 2.

Interconnecting the system 116 to the bottom of horizontal stud 104 is a form work or plate 122. This spans between truss or beam 120 and the bottom upwardly extending channel of stud 104. The plate acts to prevent excessive leakage of concrete, when poured, below the floor level. In applicant's prior systems identified above, particularly the one described in U.S. Pat. No. 4,259,822, the portion of the pan member normally disposed on the beam, can be extended beyond the lower channel of stud 104 to effect the purposes of the form work (see FIG. 3, pan member 124).

After the truss is erected and secured in place, it may require temporary bracing until the slab is poured on the corrugated decking of the composite floor system. This is accomplished by top connecting flange 121 and bracing bars such as shown at 126. The latter are welded to chord assembly 118 on the one end and either joist 120, brace support plate, 129, or some appropriate place along the inside vertical face of the truss; or the floor beams. The top connecting strap 121 becomes encased in concrete; and the bottom brace members can be left in permanently.

Channel, or stud member, 104 serves as a level screed line to which the concrete is poured. It also serves as an edge form to contain the concrete. The horizontal stud allows for vertical deflection of the floor while the concrete is being poured. When the concrete hardens, the vertically extending members 128 and 130, of the channel 104 engage the concrete and the concrete slab automatically gives a secure lateral tie between the truss and slab with no further field connection. I.e., there is no direct structural connection between the truss and the floor members other than bracing. This is important, because the truss is extremely stiff in a vertical direction and the floor member is considerably less stiff. Without the isolation there would be a transmission of unwanted loading to the truss assembly.

It may be desirable to allow some subsequent movement between the slab and the truss assembly after the concrete hardens. This facilitates top and bottom chord lateral adjustment. To accomplish this a less rigid connection of the horizontal stud 104 to the vertical studs 20, 22, etc., is necessary. This can be accomplished using the scheme shown in FIG. 12. Here sheet metal clip angles 132 are employed. This is a more flexible scheme than the direct weld. Realignment of both the top and bottom chords laterally can be accomplished by adjustment of the bracing 126. The more flexible clip angle allows for some rotation of the studs at the floor line.

Although one embodiment has been described particularly, of course the present invention is not to be considered as limited thereto. Alternate embodiments reflecting the breadth of the invention as defined by the scope of the appended claims should now be apparent in view of the above and of course are intended to be covered by the claimed invention.

What is claimed:

1. A truss assembly for supporting a building brick wall or other exterior facing, designed for field assembly of said brick wall or other exterior facing thereon, said truss assembly comprising:

a bottom chord;

a top chord;

a plurality of channel shaped vertical stud members, said vertical stud members spaced apart horizontally at standard construction dimensions, e.g. 2 feet on center;

a plurality of diagonals;

said stud members and diagonals each being connected at the top thereof to the top chord and connected at the bottom thereof to the bottom chord;

a support means connected to at least the bottom of the vertical stud members, said support means used for supporting the brick wall or other exterior facing from underneath and, truss-floor interconnecting means including a floor supporting stud member fixedly connected to and spanning said truss assembly horizontally, a plurality of top connecting plate means designed to cooperatively engage between a floor system forming a part of the building, and the top of said floor supporting stud member, and bottom plate means for cooperatively engaging between the floor system, including a supporting beam, and the bottom of said floor supporting stud member, whereby said floor supporting stud member serves as an edge form to contain concrete when poured to form the floor, said floor supporting stud member further including extending members which engage the concrete, and when it hardens, provides a secure lateral tie between the truss and floor, and whereby said bottom plate means acts to minimize concrete spillage when the concrete slab layer is poured.

2. The truss assembly, claimed in claim 1 further comprising tie back members fixedly connected to other members of said truss assembly, said tie back members fixedly securing said brick wall or other exterior facing in a plane substantially parallel to the plane of said truss assembly.

3. The truss assembly claimed in claim 1, including exterior sheetrock connected to said truss assembly on the exterior side thereof and including interior sheetrock connected to said truss assembly on the interior side thereof, and wherein said tie back members extend from each stud and extend through the exterior sheetrock and extend into the brick wall or other exterior facing.

4. The truss assembly claimed in claims 1, 2 or 3, including insulation batts disposed to extend alongside its adjacent diagonal and between its adjacent studs.

5. The truss assembly claimed in claims 1, 2 or 3 wherein said truss assembly futher comprises:

a pair of top end connection means for connecting the top of said truss assembly to first cooperating mounting means on a respective pair of supporting columns;

a pair of bottom end connection means for connecting the bottom of said truss assembly to second cooperating mounting means on the pair of supporting columns;

said top and bottom end connection means including means for adjusting the vertical and horizontal alignment of said truss assembly prior to installation of the brick wall or other exterior facing.

6. The truss assembly claimed in claim 5 further comprising flexible mounting clips fixedly connected between various ones of said vertical stud members and said floor supporting stud member whereby lateral adjustment of said top and bottom chords is facilitated.

7. A composite wall-floor system for a building comprising a truss assembly including:

a bottom chord;

a top chord;

a plurality of channel shaped vdrtical stud members, said vertical stud members spaced apart horizontally at standard construction dimensions, e.g. 2 feet on center;

a plurality of diagonals;

said stud members and diagonals each being connected at the top thereof to the top chord and connected at the bottom thereof to the bottom chord;

a lintel angle connected to at least the bottom of the vertical stud members, said lintel angle used for supporting a brick wall or other exterior facing from underneath;

means for fixedly securing the brick wall or exterior facing to the truss assembly;

respective pairs of top and bottom end connection means for connecting the top and bottom of said truss assembly to a pair of support columns; and, truss-floor interconnecting means including a floor supporting stud member fixedly connected to and spanning said truss assembly horizontally, a plurality of top connecting plate means designed to cooperatively engage between the floor system forming a part of the building, and the top of said floor supporting stud member, and bottom plate means designed to cooperatively engage between the floor system, including a supporting beam, and the bottom of said floor supporting stud member, whereby said floor supporting stud member serves as an edge form to contain concrete when poured to form the floor, said floor supporting stud member further including extending members which engage the concrete, and when it hardens, provides a secure lateral tie between the truss and floor, and whereby said bottom plate means acts to minimize concrete spillage when the concrete slab layer is poured, said composite wall-floor system further comprising a concrete floor system including, a poured concrete slab layer, underhanging chord assembly and joist webbing, said joist webbing fixedly interconnecting said chord assembly to said concrete slab layer.

8. The system claimed in claim 7 wherein said composite wall-floor system further comprises a bracing system for supporting the floor system while the concrete slab is poured.

9. The system claimed in claim 8 wherein said bracing system includes means for adjusting the lateral position of said top and bottom chords after the concrete slab has hardened.

10. The system claimed in claim 7 wherein said top and bottom end connection means include means for adjusting the vertical and horizontal alignment of said truss assembly.

* * * * *